United States Patent [19]

Loy

[11] Patent Number: 4,741,618

[45] Date of Patent: May 3, 1988

[54] DEVICE FOR STABILIZING THE AXIS OF A VARIABLE FIELD GUIDANCE SYSTEM WITH RESPECT TO THE AXIS OF A SIGHTING DEVICE

[75] Inventor: Fernand R. Loy, Sceaux, France

[73] Assignee: U.S. Philips Corporation, New York, N.Y.

[21] Appl. No.: 939,586

[22] Filed: Dec. 9, 1986

[30] Foreign Application Priority Data

Dec. 13, 1985 [FR] France ..... 85 18467

[51] Int. Cl.[4] ..... G01B 11/26

[52] U.S. Cl. ..... 356/152; 356/150; 356/153

[58] Field of Search ..... 356/150, 152, 153

[56] References Cited

U.S. PATENT DOCUMENTS

| | | | |
|---|---|---|---|
| 3,799,674 | 3/1974 | Guillet et al. | 356/152 |
| 4,326,799 | 4/1982 | Keene et al. | 356/152 |
| 4,326,800 | 4/1982 | Fitts | 356/152 |
| 4,385,834 | 5/1983 | Maxwell | 356/152 |
| 4,432,640 | 2/1984 | Grage et al. | 356/150 |
| 4,576,480 | 3/1986 | Travis | 356/152 |
| 4,662,727 | 5/1987 | Griffen | 356/152 |

*Primary Examiner*—Stephen C. Buczinski
*Attorney, Agent, or Firm*—Robert J. Kraus

[57] ABSTRACT

Device for stabilizing the axis (11) of a variable field guidance system with respect to the axis (2) of a sighting device (1) in which the sight axis (2) is adjusted until it is perpendicular to a plane-parallel plate (3) forming an optical reference element. An angular movement of the guidance axis (11) is registered by an error measuring device having an aperture (13) which is arranged symmetrically to the optical center (9) of the guidance system with respect to a further plane-parallel plate (15) and a detector (14) which receives the flux from the guidance beam transmitter after successive reflections from the plane-parallel plates (3 and 15). The detector (14) is connected to the input of an error measuring receiver (16) which supplies an error signal which is applied to a correction element (17) in the guidance beam path.

3 Claims, 1 Drawing Sheet

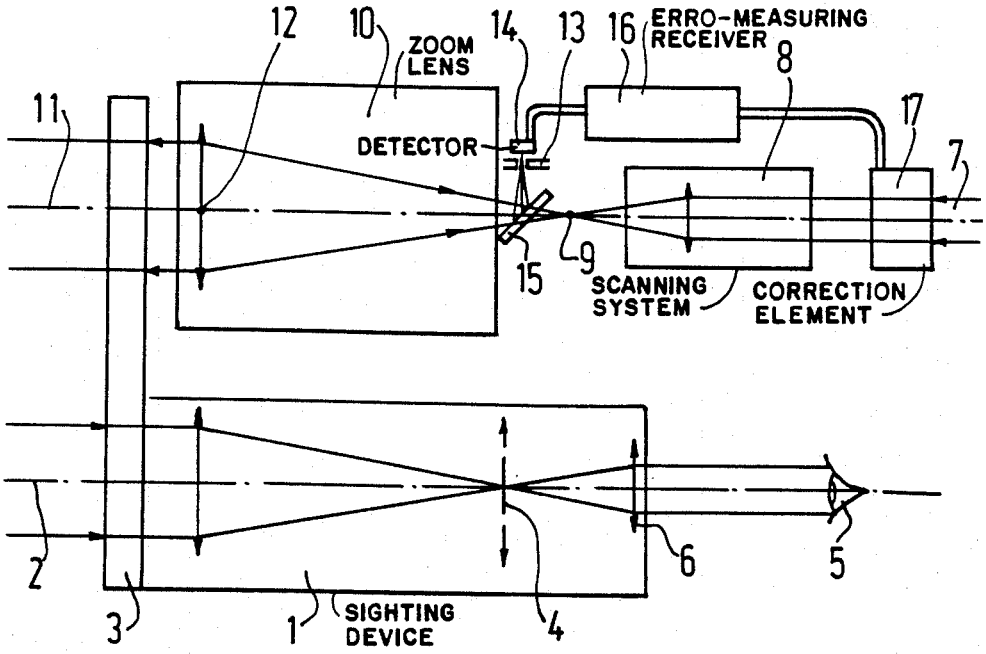
12
10
ZOOM LENS
14
13
16
ERRO-MEASURING RECEIVER
8
11
17
7
DETECTOR
15
9
SCANNING SYSTEM
CORRECTION ELEMENT
2
3
1
SIGHTING DEVICE
4
6
5

DEVICE FOR STABILIZING THE AXIS OF A VARIABLE FIELD GUIDANCE SYSTEM WITH RESPECT TO THE AXIS OF A SIGHTING DEVICE

BACKGROUND OF THE INVENTION

The invention relates to a device for stabilising the axis of a variable field guidance system with respect to the axis of a sighting device comprising an objective lens, a reticle and an ocular. The guidance system comprises an optical guidance beam transmitter, a scanning or coding system for the guidance field whose centre is projected by means of a variable focus or zoom objective lens along a collimated beam which is parallel to the guidance axis connecting the optical axis of the zoom lens and the guidance field centre.

This device is particularly used in laser beam missile guidance systems in which the angular guidance field is variable as a predetermined function of the distance of the missile.

Such systems generally use variable focus objective lenses for projecting the guidance beam along the axis defining the missile trajectory. The ratio between the focal lengths of these objective lenses between the instant of launching and the instant of the end of the flight may be higher than 100. These objective lenses are zoom lenses whose focal length is varied by moving several groups of single lens elements along the mechanical axis of the objective lens. One of the principal difficulties of realising these optical systems is to maintain a fixed direction of an optical axis for all focal lengths, which axis must be parallel to the line of sight in all conditions of the environment.

The directional stabilization of the optical axis of zoom lenses may be obtained, for example, by means of a very rigid mechanical system by compensating for all the mechanical tolerances and by minimising the system's sensitivity to temperature variations. This solution leads to heavy and costly systems.

SUMMARY OF THE INVENTION

An object of the invention is to maintain a fixed direction of this optical axis by means of a mechanism which is lighter in weight and by controlling at any instant its direction with respect to an optical reference element and by correcting it by means of a servo-control loop.

The stabilising device according to the invention is characterized in that a plane-parallel plate forming an optical reference element is rigidly fixed to the sighting device for controlling the sight axis of the sighting device. Control is effected by translating the reticle in its plane until the reticle and its autocollimated image formed by means of the plane-parallel plate and observed through the ocular are in register. Each transverse movement of the optical centre of the zoom lens which causes an angular deviation of the guidance axis is detected by an error measuring device having an aperture which is arranged symmetrical to the guidance field centre with respect to a further partial transparent plane-parallel plate. A detector arranged behind the aperture receives the flux from the guidance beam transmitter after successive reflections from the plane-parallel plates. The detector is connected to the input of an error measuring receiver whose output supplies an error signal which is a measure of the deviation of the optical axis of the zoom lens with respect to its nominal position and which is applied to a correction element in the guidance beam path for deflecting this beam and varying the position of the guidance field centre in such a manner that the error is eliminated.

BRIEF DESCRIPTION OF THE DRAWING

The invention will now be described in greater detail with reference to the accompanying drawing. The sole FIGURE shows a schematic representation of a device according to the invention.

DESCRIPTION OF THE PREFERRED EMBODIMENT

The sighting device 1 defines the sight axis 2 which is controlled by a construction perpendicular to the plane-parallel plate 3 which is fixed rigidly to the sighting device 1. This control is realised, for example, by translating the reticle 4 in its plane until the reticle and its image are in register. The image of the reticle, formed in the reticle plane, is obtained by autocollimation using the plane-parallel plate 3. An observer 6 observes the image through an ocular 6. For this control the reticle should be light-emitting or it should be lit by a source not shown.

The guidance system comprises a laser beam 7, a scanning or coding system 8 for the guidance field having a centre 9 and a variable focus projection objective lens 10. Axis 11 is the guidance axis.

This guidance axis 11 must be stable for all focal lengths of the zoom lens 10 and must be parallel to the axis 2 in spite of mechanical imperfections of the zoom lens (play, dilatations, etc.).

The axis 11 passes through the optical centre 12 of the zoom lens (shown as a single lens) and the centre 9 of the guidance field. Each transverse movement of the optical centre 12 causes an angular deviation of the axis 11. This movement is registered by an error measuring device having an aperture 13 in front of a detector 14 which receives the flux emitted by the guidance transmitter after reflection from the plate 3 and the partial transparent plate 15. The aperture 13 and the guidance field centre 9 are symmetrically arranged with respect to the plate 15. This assembly is rigid and non-deformable.

The detector 14 is provided with an error measuring receiver 16 similar to that of the missile. Thus the error of the axis 11 with respect to its nominal position can be measured at any instant.

The error signal is applied to a correction element 17 for deflecting the laser beam 7 and varying the position of the centre 9 of the field in such a manner that the error is eliminated.

In certain cases the correction element 17 may be incorporated in the scanning system 8 so that it directly influences the scanning of the field. Then no supplementary deflection element is needed.

The device is adjusted by:

1. adjusting the axis 2 until it is perpendicular to the plate 3;
2. making the axis 11 parallel with respect to the axis 2 by means of a suitable control equipment for an arbitrary focal length of the zoom lens;
3. adjusting the position of the aperture 13 until the error measuring device 16 supplies a zero error signal; and
4. switching on the servo-control and verifying if the error is eliminated for all focal lengths of the zoom lens.

The advantages as compared with the control of the axis 11 by means of an external error measuring device are the following:

The magnification between the centre 9 and aperture 13 is always unity independent of the focal length of the zoom lens because this lens is traversed twice.

The flux traversing the aperture 13 is constant; the dynamic range of the error measuring device may be small; the measuring accuracy is optimum.

The transmission factor of the plates 3 and 15 is approximately 95%; the guidance beam is slightly attenuated.

The total aperture of the guidance beam is utilized and there is no loss of resolution by diffraction due to the beams being stopped down; the measuring accuracy is optimum.

The device has minimal dimensions.

What is claimed is:

1. An apparatus for stabilizing the axis of a variable-field guidance system with respect to the axis of a sighting device, said sighting device comprising an objective lens, a reticle and an ocular, and said guidance system comprising an optical-guidance beam transmitter for producing an optical beam, a scanning/coding system for focusing the beam at a guidance field center, and a variable-focus objective lens for producing from the focused beam a collimated beam which is projected parallel to a guidance axis connecting an optical center of the variable-focus lens and the guidance field center;

characterized in that said apparatus comprises:

(a) a plane-parallel plate rigidly attached to the sighting device for establishing a sight axis and for extending through the collimated beam;

(b) means for moving the reticle in a plane defined thereby to establish registration of the reticle and an autocollimated image formed by the plane-parallel plate as observed through the ocular; and (c) means for correcting for an angular deviation of the guidance axis with respect to a nominal position, comprising:

(1) a partial-transparent plane-parallel plate disposed between the guidance field center and the variable-focus objective lens for directing transversely of the guidance axis radiation from the collimated beam reflected by the plane-parallel plate;

(2) an error-measuring device including an aperture disposed for passing the transversely-directed radiation, a detector arranged behind the aperture for receiving the radiation, and an error-measuring receiver connected to the detector for producing an error signal representing said angular deviation; and (3) a correction element disposed in the path of the beam for redirecting the beam to relocate the guidance field center such that said angular deviation is corrected.

2. An apparatus as in claim 1 where the optical guidance beam is a laser beam.

3. An apparatus as in claim 1 or 2 where the correction element is incorporated in the scanning system to effect scanning of the field.

* * * * *